US005425514A

United States Patent [19]

Grosso

[11] Patent Number: 5,425,514

[45] Date of Patent: Jun. 20, 1995

[54] MODULAR AERODYNAMIC GYRODYNAMIC INTELLIGENT CONTROLLED PROJECTILE AND METHOD OF OPERATING SAME

[75] Inventor: Vincent A. Grosso, Hopkinton, Mass.

[73] Assignee: Raytheon Company, Lexington, Mass.

[21] Appl. No.: 174,749

[22] Filed: Dec. 29, 1993

[51] Int. Cl.[6] ..... F41G 7/00

[52] U.S. Cl. ..... 244/3.22

[58] Field of Search ..... 244/3.22, 3.21, 3.15, 244/3.1, 3.23

[56] References Cited

U.S. PATENT DOCUMENTS

| | | | |
|---|---|---|---|
| 3,843,076 | 10/1974 | King et al. | 244/3.16 |
| 3,905,563 | 9/1975 | Nagoshi | 244/3.15 |
| 4,347,996 | 9/1982 | Grosso | 244/3.16 |
| 4,370,716 | 1/1983 | Amieux | 364/434 |
| 4,504,032 | 3/1985 | Phillips et al. | 244/170 |
| 4,542,870 | 9/1985 | Howell | 244/3.15 |
| 4,676,456 | 6/1987 | Grosso et al. | 244/3.21 |
| 4,690,351 | 9/1987 | Beckerleg et al. | 244/3.16 |
| 4,711,152 | 12/1987 | Fortunko | 89/6.5 |
| 5,201,895 | 4/1993 | Grosso | 244/3.16 |

*Primary Examiner*—Daniel T. Pihulic

*Attorney, Agent, or Firm*—Donald F. Mofford

[57] ABSTRACT

A spinning projectile is described including a roll rate sensor for providing a spin frequency signal, a nutation frequency signal and a precession frequency signal and a seeker for providing a boresight angle signal. The spinning projectile further includes a torquer assembly, responsive to a control signal, for selectively providing a force in a desired lateral direction and a digital signal processor, responsive to the spin frequency signal, the nutation frequency signal, the precession frequency signal and the boresight angle signal, for providing a control signal to the torquer assembly to control the desired direction of the force. With such an arrangement, a projectile is provided having greater maneuverability wherein an increase in maneuver footprint is obtained by having the maneuver force equal the sum of the rocket force and the body force rather than being a difference as in known projectiles.

8 Claims, 4 Drawing Sheets

MODULAR AERODYNAMIC GYRODYNAMIC INTELLIGENT CONTROLLED PROJECTILE AND METHOD OF OPERATING SAME

BACKGROUND OF THE INVENTION

This invention relates generally to guidance systems and more particularly to a guidance system for a spin stabilized projectile.

As it is known in the art, artillery or gun systems are a major component of both ground and naval weapon systems. The effectiveness of gun systems may be greatly improved by providing projectiles in flight with a capability to maneuver to home in on a target. The costs of such projectiles must be minimized because of the large number of such projectiles expected to be used in any tactical situation. Furthermore, it is desirable to upgrade the current projectile inventory of 155 mm projectiles, 105 mm projectiles, etc. (40 mm through 8 inches diameter) rather than designing a new and different projectile.

A guidance system for a spinning projectile is described in U.S. Pat. No. 4,347,996 issued Sep. 7, 1982 to V.A. Grosso and assigned to the same assignee as this application and incorporated herein by reference. An inertial roll attitude reference system is described in U.S. Pat. No. 4,676,456 issued Jun. 30, 1987 to V. A. Grosso et al. and assigned to the same assignee as this application and incorporated herein by reference. An infrared (IR) seeker for a spinning projectile is described in U.S. Pat. No. 4,690,351 issued Sep. 1, 1987 to Richard A. Beckerleg et al. and in U.S. Pat. No. 5,201,895 issued Apr. 13, 1993 to V. A. Grosso, which are assigned to the same assignee as this application and incorporated herein by reference. Building on the concepts taught in the latter, a modular and screw on adaptable guidance and control system which can be used with existing projectiles shall be described.

SUMMARY OF THE INVENTION

With the foregoing background in mind, it is an object of this invention to provide a modular and screw on adaptable guidance and control system which can be used with existing projectiles.

Another object of this invention is to provide a control system for a projectile having an increase in maneuverability than known projectile guidance and control systems.

Still another object of this invention is to provide a guidance control system having a reduced time constant.

Still another object of this invention is to provide a spin stabilized projectile having a low cost seeker with a minimum of inertial instrumentation and few moving parts.

The foregoing and other objects of this inventions are met generally by a spinning projectile including a roll rate sensor for providing a spin frequency signal, a nutation frequency signal and a precession frequency signal and a seeker for providing a boresight angle signal. The spinning projectile further includes a torquer assembly, responsive to a control signal, for selectively providing a force in a desired lateral direction and a digital signal processor, responsive to the spin frequency signal, the nutation frequency signal, the precession frequency signal and the boresight angle signal, for providing a control signal to the torquer assembly to control the desired direction of the force. With such an arrangement, a projectile is provided having greater maneuverability wherein an increase in maneuver footprint is obtained by having the maneuver force equal the sum of the rocket force and the body force rather than being a difference as in known projectiles.

In accordance with another aspect of the present invention, a spinning projectile includes a body having a fore section and an aft section and a seeker, connected to the fore section, for providing guidance signals. The spinning projectile further includes a rocket control system, connected to the aft section, for controlling the course of the spinning projectile and means for acoustically coupling through the body of the projectile the guidance signals from the seeker to the rocket control system. With such an arrangement, existing projectiles can be retrofitted with a seeker and a rocket control system without affecting the body of the projectile.

BRIEF DESCRIPTION OF THE DRAWINGS

For a more complete understanding of this invention, reference is now made to the following description of the accompanying drawings, wherein.

DESCRIPTION OF THE PREFERRED EMBODIMENTS

Before undertaking the detailed description of the contemplated guidance system, a brief review of the technical requirements of any spin-stabilized projectile guidance system will be made. Any spin-stabilized guidance system takes advantage of the gyroscopic nature of a spinning projectile to allow a body-fixed seeker to measure the angular boresight of a target relative to an inertial reference in pitch and yaw. The boresight measurement and a corresponding roll position angle determine the spherical coordinates of a target in a body-fixed nonspinning reference coordinate system. The projectile spin rate must be known in order to establish the body-fixed, nonspinning reference coordinate system and the dynamics of the spin-stabilized projectile that are involved in the spin rate measurement. These complex dynamics include three modes including a "coning" mode or also referred to as a "lunar" mode, a "nutation" mode and a "precession" mode.

The lunar mode occurs at the spin frequency of the projectile and is caused by aerodynamic and inertial asymmetries. This mode causes the projectile to rotate about the velocity vector at a fixed coning angle, or angle of attack, at a rate equal to the spin frequency. The other two modes, nutation and precession, are similarly caused by aerodynamic forces and moments, as well as by the inertial properties of the projectile. The effect of these modes for statically unstable projectiles is to vary the angle of attack at each one of two separate frequencies lower than the spin frequency. Thus, as the centerline of the projectile rotates about the velocity vector, the resulting angle of attack is modulated by the amplitudes and frequencies of the two separate modes. Consequently, the measured seeker boresight data contains the lead angle component (the angle between the velocity vector of the projectile and the line-of-sight (LOS) vector to the target) modulated by coning, nutation and precession. Furthermore, any force of thrust used to change the course of the projectile must anticipate the effect the force of thrust will have on the coning, nutation and precession motions. As to be described, the LOS rate is estimated by the seeker guidance electronics and when the LOS rate exceeds an acceptable threshold, a torque thruster is fired to achieve guidance corrections. For a M483A1 155 mm type projectile travelling at Mach=0.8, typically the lunar mode will have a spin frequency of 120 Hz, the nutation frequency is 10 Hz and the precession frequency is one Hz.

Figure 1:
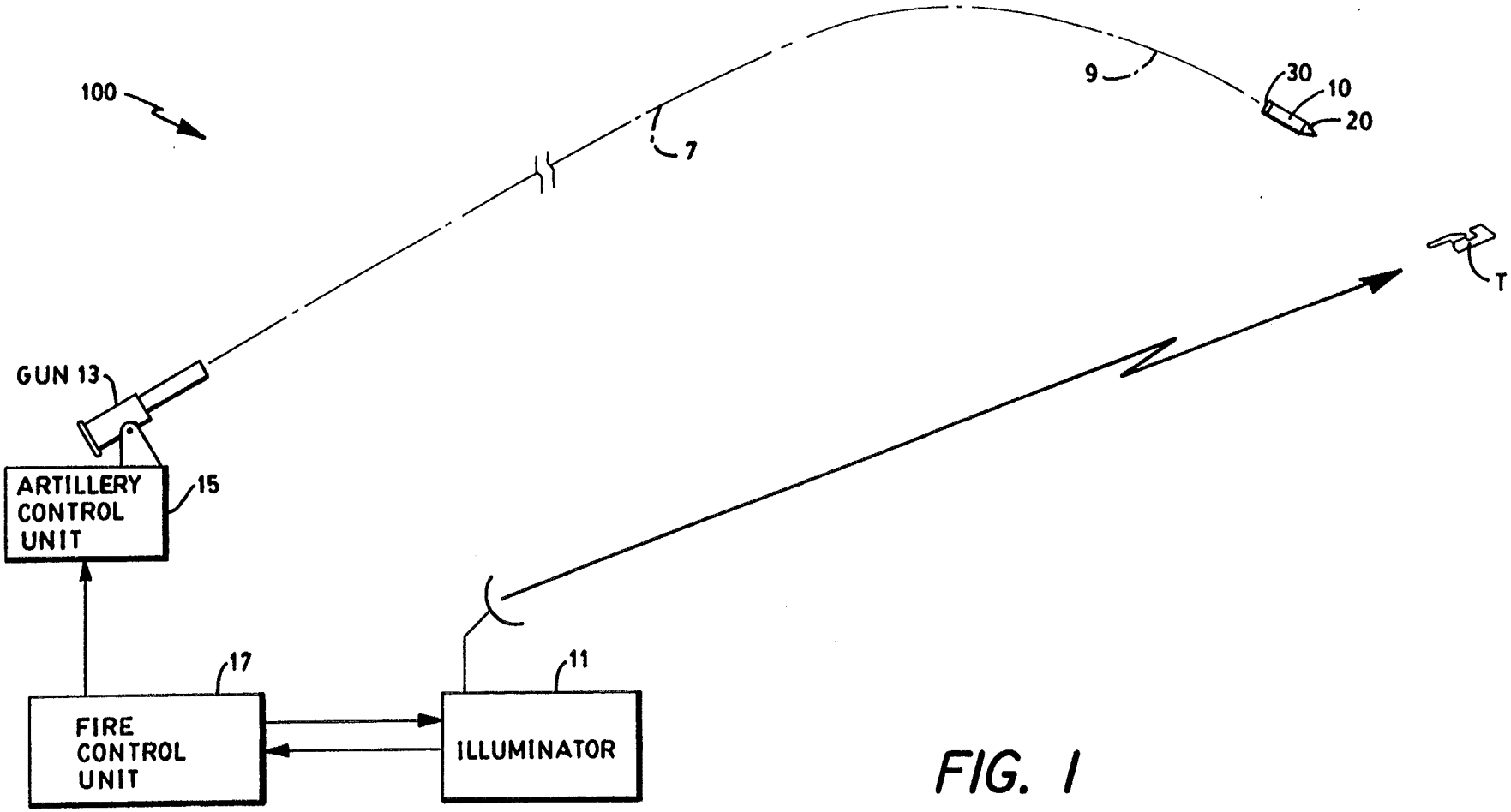
FIG. 1 is a sketch illustrating an exemplary tactical situation showing generally the major components of the contemplated system.

Referring now to FIG. 1, a gun control system 100 is shown to include an illuminator 11 for illuminating a target, T, an artillery gun 13 and an artillery control unit 15, all of which are controlled by a fire control unit 17. A spin-stabilized projectile 10 is shown to have been fired from the artillery gun 13 toward the target, T, which is being illuminated by a beam of laser energy from the laser illuminator 11. It should be appreciated that the just described elements constitute a conventional gun control system whereby a projectile 10 is fired toward a predicted point of impact with the target, T. However, maneuvering by the target, T, will reduce the probability of successful interdiction. To increase the probability that the projectile 10 will actually intercept the target, T, the projectile 10 is fitted with a screw on strapdown seeker 20 and a screw on rocket control system 30 as to be described further hereinafter. Suffice it to say here, the screw on strapdown seeker 20 and the screw on rocket control system 30 are effective during the flight of the projectile 10 to adjust the trajectory thereof to direct the projectile 10 to impact with the target, T or at least to a point within lethal range so that the target, T, is interdicted.

As shown, the projectile 10 will follow a trajectory course 7 as initially set by the artillery control unit 15. Upon reaching a point 9, the screw on strapdown seeker 20 and the screw on rocket control system 30 are activated to adjust the trajectory course 7 of the projectile 10 to direct the latter to impact with the target, T. At point 9 of the trajectory course 7, a thrust rocket (not shown) is fired. The thrust rocket of the projectile 10 is initially body fixed so that the thrust vector rotates here at a 120 Hz spin rate of the projectile 10 when the thrust vector is initially stabilized which causes the centerline of the projectile 10 to trim to an angle of attack of 14° and to rotate about the velocity vector. After trim is achieved, it is respun to the spin rate of the projectile causing the lift vector to rotate about the velocity vector at the same rate and no maneuver is introduced. As to be described, when a maneuver is required, the thrust vector is inertially stabilized in the desired direction by despinning a nozzle (not shown) relative to the projectile 10 with a small electric motor and controller. The projectile continues to spin about its centerline but is trimmed at the 14° angle of attack in the desired plane for the maneuver. The combined lift and rocket force are added and a maneuver is initiated in the desired plane. When the maneuver is completed the nozzle is allowed to respin to the 120 Hz spin rate by the application of the electric brake (not shown) and all further changes in the trajectory are canceled.

Figure 1A:
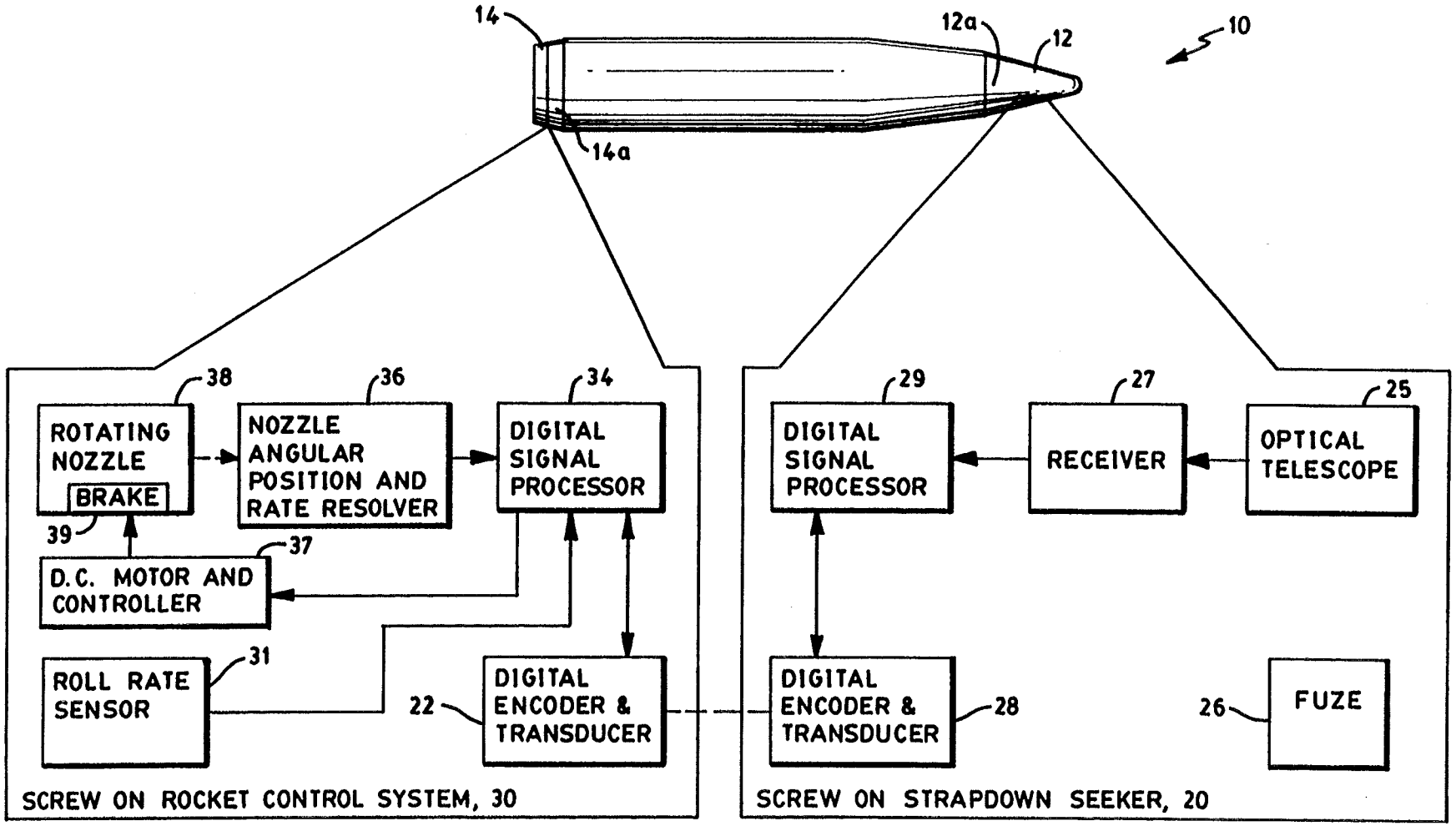
FIG. 1A is a block diagram of a modular screw on guidance system for a spinning projectile according to the invention.

Referring now to FIG. 1A, the spin-stabilized projectile 10 includes here, a laterally ported, constant 100 lb. thrust rocket (not shown), mounted aft of here a 155 mm M483A1 spin stabilized projectliens center of gravity, to generate a fixed angle of attack. A seeker 20 having an optical telescope 25, a receiver 27, a digital signal processor 29 and a digital encoder and transducer 28 is mounted to the front of the projectile 10. The seeker 20 is disposed in a housing module 12 having a screwable mount that is mated with the front of the projectile 10. Depending upon the type of warhead, either a proximity or a contact fuze 26 is also disposed within the housing module 12 to detonate an explosive (not shown) when the projectile 10 is within lethal range of a target. The housing module 12 is shaped to be compatible with existing 155 mm M483A1 projectiles and the like. The optical telescope 25, the receiver 27 and the digital signal processor 29 are similar to like-numbered elements in U.S. Pat. Nos. 4,347,996 and 4,676,456. The latter will, therefore, not be described in detail. Suffice it to say here that the optical telescope 25 is effective to detect infrared illumination energy reflected from a target (not shown) onto a detector array (not shown). Output signals from the latter are suitably amplified and processed in the receiver 27 prior to being digitized in an analog-to-digital converter (not shown) and applied to the digital signal processor 29.

A screw on rocket control system 30 having a digital encoder and transducer 22, a digital signal processor 34, a D.C. motor and controller 37, a rotating torque thruster nozzle 38, a brake 39, a nozzle angular position and rate resolver 36 and a roll rate sensor 31 is mounted to the rear of the projectile 10. The rocket control system 30 is disposed in a housing module 14 having a screwable mount that is mated with the rear of the projectile 10. The housing module 14 is shaped to be compatible with existing 155 mm M483A1 projectiles and the like. The housing module 12 includes an index mark **12*a* and the housing module 14 includes an index mark 14*a* wherein the index mark 12*a* and the index mark 14*a* are aligned with one another such that the relative position of housing module 12 is known with respect to housing module 14**.

Since the housing module 12 and the housing module 14 are used with existing projectiles, a technique for connecting the seeker 20 with the control system 30 is desired without affecting the body of the existing projectile. To avoid the need for connecting wires between the seeker 20 and the control system 30, a digitally encoded acoustic signal is transmitted from the front to the rear through the metal body of the projectile 10. The digital encoder and transducer 22 digitally encodes digital signals from the digital signal processor 29 onto an acoustic signal which is coupled through the metal body of the projectile 10 and received by the digital encoder and transducer 32. The digital encoder and transducer 32 decodes the digital signal from the acoustic signal and feeds the digital signal to the digital signal processor 34. The latter also receives digitized output signals from a roll rate sensor 31 as to be described further hereinafter. Suffice it to say here that the roll rate sensor 31 provides signals to resolve the relationship between a nonspinning reference coordinate system and a body-fixed spinning coordinate system. The digital signal processor 34 operates on the signals provided by the digital signal processor 29 and the roll rate sensor 31 to provide signals to derive fire control signals to control the rotating torque thruster nozzle 38.

The thrust rocket of the projectile 10 is body fixed so that the thrust vector rotates here at a 120 Hz spin rate of the projectile 10. This causes the centerline of the projectile 10, at a trim angle of attack of 14°, to rotate about the velocity vector. Thus, the lift vector also rotates about the velocity vector at the same rate, and does not induce any maneuver. As to be described, when a maneuver is required, the thrust vector is inertially stabilized in the desired direction by despinning the nozzle 38 relative to the projectile 10 with a small electric motor and controller 37. The projectile continues to spin about its centerline but is trimmed at the 14° angle of attack in the desired plane for the maneuver. The combined lift and rocket force are added and a maneuver is initiated in the desired plane. When the maneuver is completed the nozzle 38 is allowed to respin to the 120 Hz spin rate by the application of the electric brake 39 and all further changes in the trajectory are canceled.

Digressing briefly here for a moment, it should be appreciated that conventional geometry spin stabilized projectiles are symmetrical, less than six caliber's in length and, by design, statically unstable. Therefore, the pitch moment coefficient, $Cm\alpha$, generated by the angle of attack is positive. Static instability implies that any aerodynamic angle of attack generates a moment that tries to increase the angle of attack. Dynamic stability of the projectile can only be achieved at high spin rates.

Fin stabilized projectiles may or may not be symmetrical and are statically stable. The pitch moment coefficient, $Cm\alpha$, is negative, and these configurations are usually much longer than six calibers. Statically stable missile configurations develop aerodynamic moments that oppose the generation of angle of attack. Dynamic stability can be achieved with or without spinning the projectile.

The dynamic stability of a statically unstable projectile depends on the spin stability factor. For stability it must have a value greater than one. The spin stability factor is a function of the square of the product of the spin rate and roll moment of inertia divided by the product of the pitch moment coefficient, $Cm\alpha$, the dynamic pressure, the projectile's diameter, the reference area, and the pitch moment of inertia. If the spin stability factor is greater than one then the projectile has three modes of motion: lunar, nutation and precession.

The spin stability factor for a spinning, statically stable projectile is negative because the pitch moment coefficient, $Cm\alpha$, is negative. The projectile is dynamically stable for spin stability factors equal to or less than zero except when dynamic coupling between roll and pitch occurs. This phenomenon is called roll/pitch resonance and occurs when the spin frequency is equal to the nutation frequency. This is not a real problem for gun fired, spin stabilized projectiles because at launch the spin rate is well above the nutation frequency. With appropriate fin settings to maintain spin proportional to velocity, the spin rate can be maintained well above the nutation frequency.

Roll/pitch resonance does not occur with statically unstable, spinning projectiles, but catastrophic yaw movement can destroy stability if the spin stability factor falls below a value of one. Again this is not a problem with proper design for gun fired projectiles.

One known technique for controlling statically unstable, spin stabilized projectiles is utilizing Canard control surfaces added to the front of the projectile. To maneuver to the right, the Canard control surfaces are deflected to produce a lift force to the left and a counter clockwise moment. The moment causes the projectile to precess up and to the right until body trim with negative side slip angle is achieved producing a body force to the right. The small net maneuver force generated is equal to the difference between the body produced lift force to the right (Lb) and the canard produced lift force (Lc) to the left: Net Maneuver Force=Lb−Lc.

The latter technique produced an inadequate maneuver footprint for terminal homing applications since the maximum achievable lateral acceleration was less than 0.25 g's. Also, the closed loop guidance system time constant for a 155 mm projectile application during terminal engagements (Mach Number=0.8) was much greater than a required 0.5 seconds. The minimum time constant was limited by the low precession frequency of 1.0 Hz, producing a first order lag at 0.16 seconds, and an aerodynamic lead time constant ($\alpha/\gamma$) of 27 seconds which attracted the first order pole when the guidance and control loop was closed with conventional linear feedback control techniques. The combination of low maneuver g's and poor guidance system response resulted with a small maneuver footprint and poor miss distance performance.

In the contemplated invention, two problems were addressed. First, how to get the force producing the moment that generates a trim angle of attack to be in the same direction as the body trim lift force. If this is accomplished then the generated maneuver force is equal to the sum rather than the difference of these two force vectors. Second, how can the guidance time constant be reduced below 0.5 sec to improve miss distance performance.

To accomplish the latter, a constant thrust, continuous burn, laterally ported rocket is mounted at the rear of a statically unstable ($Cm\alpha$ is positive and $Cn\beta$ is negative), spin stabilized projectile to produce a pitching or yawing moment to generate a trim angle of attack and also to excite the lunar mode. Since no aerodynamic surfaces are added to the rear of the projectile's center of gravity (cg), $Cm\alpha$ remains positive and $Cn\beta$ is negative.

By using a continuous burn, constant thrust rocket, the projectile 10 trims to a maximum angle of attack. If the rocket nozzle is body fixed and rotating, the lunar mode causes the projectile, trimmed at the maximum angle of attack, to rotate about the velocity vector at the spin frequency. The amplitude of the total angle of attack of the lunar mode depends on the magnitude of the moment produced by the lateral thrust vector acting at a distance aft of the projectile center of gravity (cg) and the balancing aerodynamic moment which depends on the dynamic pressure and the magnitude and sign of $Cm\alpha$ and $Cn\beta$.

For the 155 mm projectile in the terminal portion of trajectory, the maximum lift vector generated by the trim angle of attack rotates about the velocity vector at a spin frequency of approximately 120 Hz, and no maneuver is produced. To maneuver to the right, the rocket is vented in an inertially fixed direction producing a thrust (T) to the right. The resulting counter clockwise negative moment causes the projectile to precess up and to the right until body trim with a negative side slip angle is achieved. This produces a positive yawing moment, which cancels the rocket induced negative moment, and a body trim lift force (Lb) to the right. A large maneuver force is generated equal to the sum of the rocket force to the right and the body lift force to the right: Net Maneuver Force=Lb+T. For a rocket thrust of 100 lbs located at the base of a M483A1 projectile, a maximum trim angle of attack of 14° is achieved, producing a body lift force of 85 lbs and a net maneuver force of 185 lbs. For a 100 lb projectile, this equates to a 1.85 g maneuver capability. The aerodynamic lead time constant ($\alpha/\dot{\gamma}$) is also reduced from 27 seconds to 3.66 seconds.

To achieve a maneuver, the thrust vector has to be despun and inertially stabilized in the desired direction for the trajectory correction. To accomplish this task, a laterally vented rocket nozzle is embedded in a ceramic composite disk to provide the rotating nozzle 38 which is mounted on the base of the projectile 10. The rotating nozzle 38 can be despun relative to the projectile 10 with a small, high torque, dc electric motor 37. The spin rate of the nozzle relative to the projectile is measured by a nozzle angular position and rate resolver 36 and the inertial spin rate of the projectile is measured by the roll rate sensor 31. As soon as the thrust vector is inertially stabilized, the lunar mode is interrupted, the projectile 10 trims at the established angle of attack in the desired plane of motion and continues to spin about it's centerline at the 120 Hz rotation rate due to conservation of angular momentum.

After the correction is applied to the trajectory course 7 (FIG. 1), the nozzle 38 is respun to the projectile spin rate by the application of an electrically controlled brake 39 and the rotating maneuver force vectors cancel further maneuver. Since the angle of attack is held constant, the maneuver time constant depends only on how fast the rotating nozzle 38 can be despun and stabilized in the desired direction by the motor 37 and respun by the brake 39. The coupling of the 1.0 Hz precession frequency and the aerodynamic lead time constant ($\alpha/\dot{\gamma}$) is no longer a factor since no changes in the angle of attack are generated, only it's orientation in three dimensional space is altered.

The optical telescope 25 is effective to detect infrared illumination energy reflected from a target (not shown) onto the detector array (not shown). Output signals from the latter are suitably amplified and processed in the receiver 27 prior to being digitized in an analog-to-digital converter (not shown) and applied to the digital signal processor 29. As taught in U.S. Pat. No. 4,347,996, the receiver 27 is effective to provide signals indicative of the line-of-sight between the projectile 10 and the target, T (FIG. 1) which when compared with the velocity vector, $\overline{V}_v$, provides a lead angle required if impact is to be achieved. A boresight angle, as measured between the longitudinal axis of the projectile 10 and the line-of-sight to the target, is an instantaneous angle determined continuously during flight by the digital signal processor 29. It should be appreciated that the directional signals in body coordinates out of the receiver 27 and fed to the digital signal processor 29 are indicative of the lead angle with the effects of precession and nutation included. The digital signal processor 29 using techniques well known in the art determines the time rate of change of the lead angle and provides a digital signal indicative of the lead angle in body coordinates to the digital encoder and transducer 28.

The digital encoder and transducer 28 is effective to pulse code modulate the digital signal from the digital signal processor 29 onto an acoustical carrier signal. The acoustical carrier signal is coupled to the body of the projectile 10 wherein the acoustical carrier signal propagates along the body of the projectile 10 to the aft of the projectile 10. The digital encoder and transducer 22 is disposed adjacent an aft portion of the body of the projectile 10 wherein the acoustical carrier signal is captured by the digital encoder and transducer 22 and converted to a digital signal which is fed to the digital signal processor 34. It should be appreciated that the latter technique allows existing projectiles to be retrofitted with the screw on strap down seeker 20 and the screw on rocket control system 30 without disrupting the body of the projectile.

The roll rate sensor 31 includes an accelerometer 31*a* which produces a signal which is sinusoidal at the spin frequency and sinusoidally modulated at the precession frequency and the nutation frequency and operates as described in U.S. Pat. No. 4,676,456. Suffice it to say here, the roll reference system 31 is effective to compute the spin frequency, p, the nutation frequency, $a_N$, and the precession frequency, $a_p$. A digital signal indicative of the spin frequency, p, the nutation frequency, $a_N$, and the precession frequency, $a_p$ is fed to the digital signal processor 34. The digital signal processor 34 is effective to calculate guidance and control (G&C) commands to control the D.C. motor and controller 37 which controls the rotating nozzle 38.

Figure 2A:
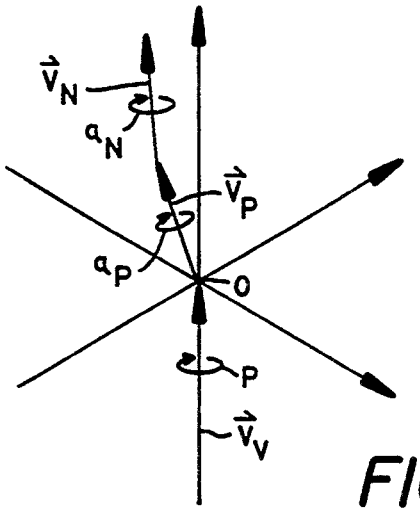
FIGS. 2A, 2B and 2C are sketches useful in understanding the non-linear guidance and control technique according to the invention.
Figure 2B:
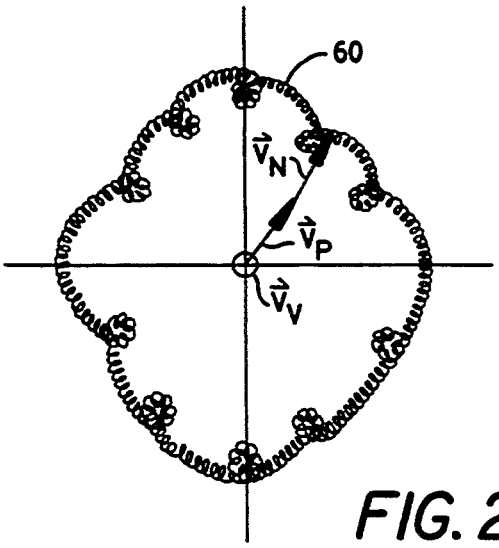

Before proceeding with a detailed description of the contemplated signal processing technique within the digital signal processor 34 that is intended to control the course of the projectile 10, a brief review of the forces at play will be beneficial. As illustrated in FIG. 2A, a velocity vector $\overline{V}_v$ is propelling the projectile 10 forward with the center of gravity (cg) of the projectile 10 shown at the origin, 0. The projectile 10 rotates in a clockwise direction about the origin, 0, at the spin rate, p. A nutation vector $\overline{V}_N$ is attached to the tip of the velocity vector $\overline{V}_v$ and rotates with the latter about the origin, 0, at the spin rate, p. The nutation vector $\overline{V}_N$ also rotates, in a clockwise direction, about the tip of the velocity vector $\overline{V}_v$ at the nutation rate $a_n$. A precession vector $\overline{V}_p$ is attached to the tip of the nutation vector $\overline{V}_N$ and with the velocity vector $\overline{V}_V$ and the nutation vector $\overline{V}_N$ rotates about the origin, 0, at the spin rate, p. The precession vector $\overline{V}_P$ also rotates, in a clockwise direction, about the tip of the nutation vector $\overline{V}_N$ at the precession rate $a_p$. Thus, with a precession rate $a_p$ of one Hz and a nutation rate $a_N$ of ten Hz, the centerline of the projectile 10 moves in a pattern 60 as shown in FIG. 2B about the velocity vector $\overline{V}_V$.

As described in U.S. Pat. No. 4,676,456, the spin rate, p, the nutation rate, $a_n$, and the precession rate, $a_p$ can be determined. By knowing the spin rate, p, the nutation rate, $a_n$, and the precession rate, $a_p$, and the boresight error angle in body coordinates, the time rate of change of the lead angle in fixed coordinates can be calculated. To achieve a maneuver, the thrust vector has to be despun and inertially stabilized in the desired direction in fixed coordinates for the trajectory correction. To accomplish this task, the rotating nozzle 38 is despun relative to the projectile 10 with the small, high torque, dc electric motor 37. The spin rate of the nozzle relative to the projectile is measured by the nozzle angular position and rate resolver 36 and the inertial spin rate of the projectile 10 is measured by the roll rate sensor 31. As soon as the thrust vector is inertially stabilized, the lunar mode is interrupted, the projectile 10 trims at the established angle of attack in the desired plane of motion and continues to spin about it's centerline at the 120 Hz rotation rate due to conservation of angular momentum.

After the correction is applied to the trajectory course 7 (FIG. 1), the nozzle 38 is respun to the projectile spin rate by the application of an electrically controlled brake 39 and the rotating maneuver force vectors cancel further maneuver. Since the angle of attack is held constant, the maneuver time constant depends only on how fast the rotating nozzle 38 can be despun and stabilized in the desired direction by the motor 37 and respun by the brake 39.

Figure 2C:
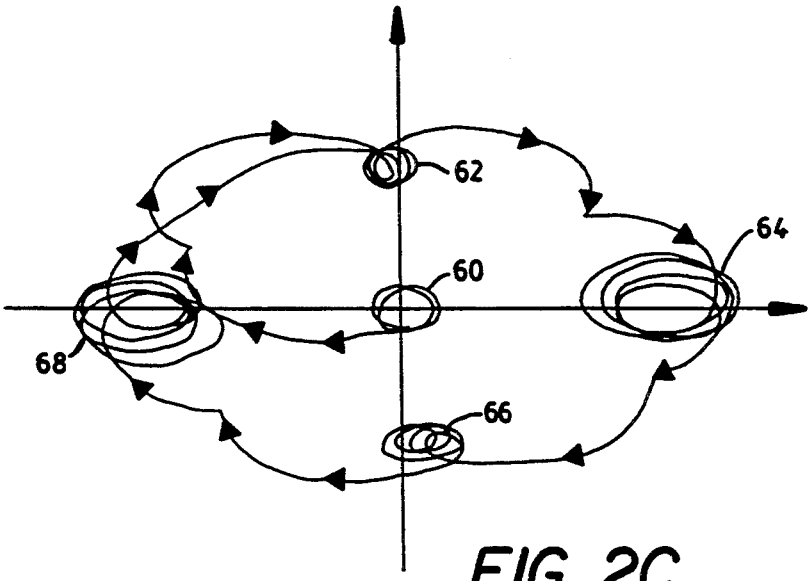

Referring now to FIG. 2C, a plot of the centerline of the projectile 10 is shown of a simulation as the projectile 10 is maneuvered about in fixed coordinates. Thus, the projectile 10 is moving in a pattern 60 as also shown in more detail in FIG. 2B. If a maneuver is desired, the rotating nozzle 38 is despun relative to the projectile 10 with the motor 37. The spin rate of the nozzle relative to the projectile is measured by the nozzle angular position and rate resolver 36 and the inertial spin rate of the projectile 10 is measured by the roll rate sensor 31. As soon as the thrust vector is inertially stabilized, the lunar mode is interrupted, the projectile 10 trims at the established angle of attack and is moving in a pattern 62. The nozzle 38 is respun to the projectile spin rate by the application of an electrically controlled brake 39 and the rotating maneuver force vectors cancel further maneuver. Again, if a maneuver is desired, the rotating nozzle 38 is despun relative to the projectile 10 with the motor 37. As soon as the thrust vector is inertially stabilized, the lunar mode is interrupted, the projectile 10 trims at the established angle of attack and is moving in a pattern 64. The nozzle 38 is respun to the projectile spin rate by the application of the electrically controlled brake 39 and the rotating maneuver force vectors cancel further maneuver. As shown in the simulation as the projectile 10 is maneuvered about in fixed coordinates, the projectile 10 can be similarly maneuvered in fixed coordinates from pattern 64 to pattern 66, from pattern 66 to pattern 68 and from pattern 68 to pattern 62 wherein the rotating nozzle 38 is despun relative to the projectile 10 with the motor 37 and the projectile 10 is moving in a new pattern. The nozzle 38 is respun to the projectile spin rate by the application of the electrically controlled brake 39 and the rotating maneuver force vectors cancel further maneuver.

It should be appreciated that if it had been desirable to move from pattern 60 to pattern 66 instead of from pattern 60 to pattern 62 as shown above, then the rotating nozzle 38 is despun relative to the projectile 10 with the motor 37 with the nozzle 38 positioned in the opposite direction in fixed coordinates with the desired maneuver achieved.

It should now be apparent, the projectile 10 can be maneuvered about in fixed coordinates changing the trajectory course 7 (FIG. 1) of the projectile 10. Since the angle of attack is held constant, the maneuver time constant depends only on how fast the rotating nozzle 38 can be despun and stabilized in the desired direction by the motor 37 and respun by the brake 39.

As described hereinabove, the nozzle angular position and rate resolver 36 monitors the position and rate of rotation of the rotating nozzle 38 and provides such information to the digital signal processor 34. The digital signal processor 34 uses such information to adjust control signals to the D.C. motor and controller 37 to control the trajectory course of the projectile 10.

It should be appreciated that a modular integrated GPS receiver and IMU in place of the optical telescope 25 and receiver 27 could be used to provide guidance and control signals with the acoustic data link coupling signals to the control system 30. The IMU can be initialized in flight before the lateral rocket is ignited by measuring the spin rate and noting the build up of gyro pitch hang off error caused by the acceleration of gravity rotating the velocity vector in the vertical plane, Alternatively, a rear looking antenna and up link receiver could be included in the control system 30 to allow the reception of guidance and control (G&C) commands from a fire control tracking system. The lateral rocket plume could be tracked with a high resolution IR telescope to determine up, down, right and left commands for transmission of synchronized guidance commands to guide the projectile to the target.

Furthermore, an radio frequency seeker using known radar techniques can be used to provide guidance and control signals to the digital signal processor 29 instead of using the optical telescope 25 and the receiver 27.

In all of these guidance and control options, the basic exterior geometry of the projectile is unchanged. This is a big advantage and cost savings in development allowing the use of established ballistic firing tables for all of the projectiles that would be fitted with the contemplated system.

Figure 3:
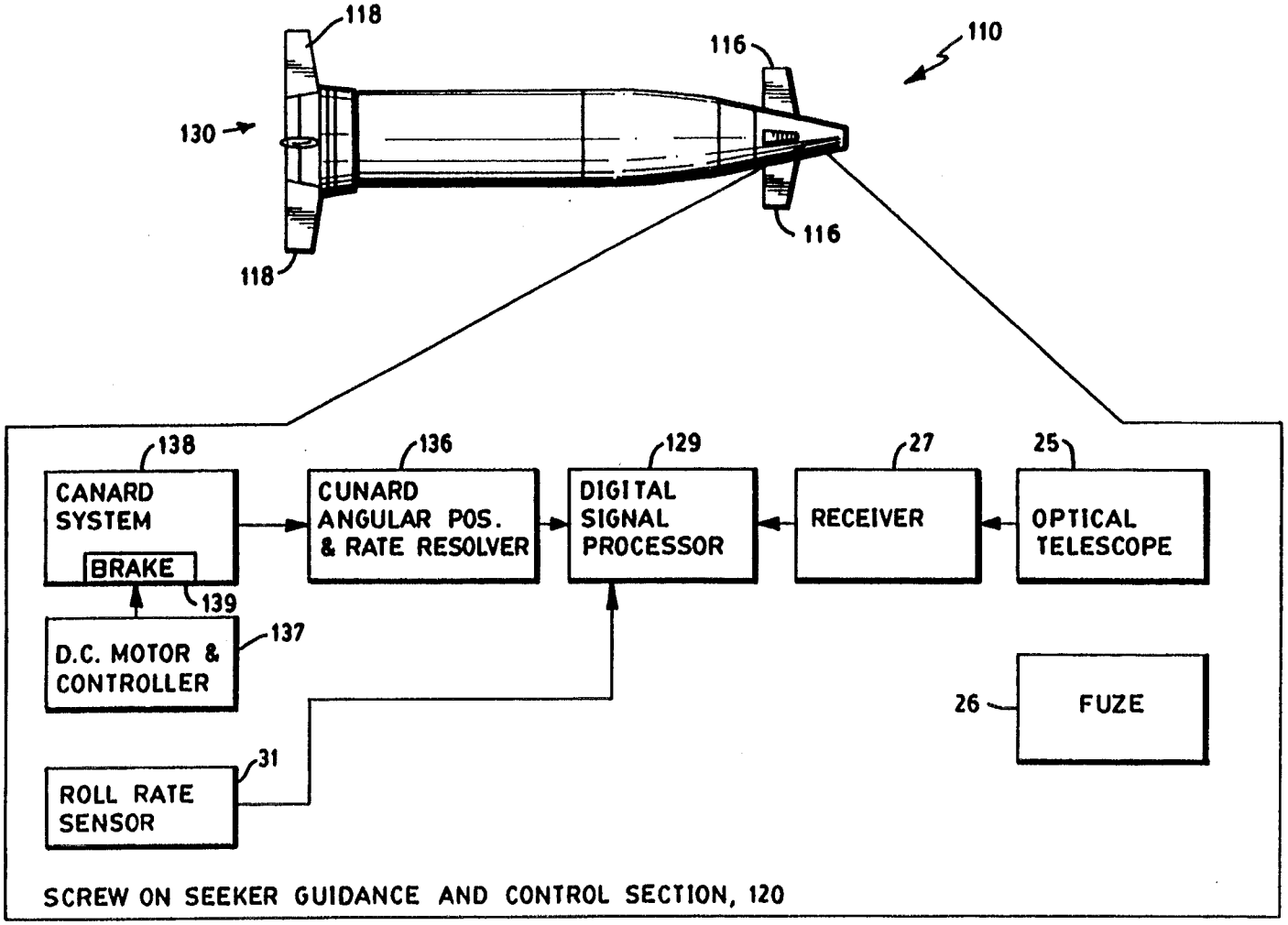
FIG. 3 is an alternative all aerodynamic embodiment of a guidance system according to the invention.

An alternative embodiment for a spinning projectile 110 is shown in FIG. 3 with the contemplated control technology used in a purely aerodynamic mode. A projectile 110 includes a screw on seeker guidance and control section 120 mounted on the front of the projectile 110 and a screw on wrap around tail fin assembly 130 mounted on the rear of the projectile 110. If body fixed tail fins 118 of sufficient size are added to the rear of the projectile 110 and deployed when guidance is to begin, $Cm\alpha$ can be made negative and $Cn\beta$ can be made positive making the projectile statically stable. If the tail fins 118 are set at an appropriate differential angle of incidence relative to the projectile centerline any desired spin rate can be maintained. With the screw on seeker guidance and control section 120 having two opposing or four cruciform canard blades 116 added to the front of the projectile 110, the contemplated nonlinear guidance and control technique can be implemented without the need for a laterally ported rocket.

The opposing canard blades 116 set at a fixed angle of incidence can generate a body fixed moment exciting the lunar mode and allow the projectile 110 to trim to a desired angle of attack (i.e. 14°). Since the spinning projectile 110 with the addition of tail fins 118 is statically stable (a negative $Cm\alpha$ and a positive $Cn\beta$), a canard force to the right along the body fixed y axis would induce a positive yawing moment and cause the projectile 110 to precess downward inducing a negative angle of attack. This negative angle of attack would generate a positive pitching moment causing the projectile 110 to precess to the right generating a negative yawing moment, negative trim side slip angle and a body force to the right. As in the case of the statically unstable spinning projectile with a rear mounted, laterally ported rocket, a large maneuver force is generated equal to the sum of the canard yawing force to the right and the body lift force to the right: Net Maneuver Force=Lb+ T. As long as the deflected canard blades 116 are body fixed and rotating at the spin frequency, no maneuver is initiated since both the canard and body lift vectors are rotating around the aerodynamic velocity vector. When a maneuver is desired, the canard control system 138 mounted on a spin bearing (not shown) can be despun relative to the projectile 110 by a small dc motor 137 and respun with the use of a brake 139 as described in the previous embodiment. Alternatively, by differential deflecting the other opposing pair of canards 116, the canard system 138 can be despun relative to the projectile 110.

Since the distance from the forward mounted canards to the center of gravity of the projectile is approximately 1.5 times as large as the distance from the rear mounted rocket, to trim to a 14° angle of attack, the deflected canards would only be required to generate $\frac{2}{3}$ of the 100 lb rocket thrust. Therefore, a total canard force of 66.66 lbs (33.33 lbs. per blade) plus the body generated lift of 85 lbs would produce a total maneuver force of 151.66 lbs. For the same 100 lb projectile, these combined forces would generate 1.52 g's of maneuver acceleration and an $(\alpha/\dot{\gamma})$ of 4.46 seconds.

After the correction is applied to the trajectory, the canard control system is respun to the projectile spin rate by the application of a brake or by differential deflection, and the rotating maneuver force vectors cancel further changes in the trajectory. Since the angle of attack is held constant, the maneuver time constant depends on how fast the canard control system can be despun and stabilized in the desired direction and respun. As in the previous embodiment, coupling of the 1.0 Hz precession frequency and the 4.46 second aerodynamic lead time constant $(\alpha/\dot{\gamma})$ is not a factor in the guidance time constant since no changes in angle of attack are needed. Only the projectile's orientation in three dimensional space is controlled.

The rear mounted tail fins 118 are deployed with the use of a timer (not shown) and since they are fixed no acoustic link with the forward mounted control section 120 is needed. All of the seeker guidance and control system is located in the housing module 112. The addition of aerodynamic surfaces completely alters the ballistics of the projectile 110, requiring the generation of a new set of firing tables for each application.

Having described this invention, it will now be apparent to one of skill in the art that various modifications could be made thereto without affecting this invention. It is felt, therefore, that this invention should not be restricted to its disclosed embodiment, but rather should be limited only by the spirit and scope of the appended claims.

What is claimed is:

1. A spinning projectile comprising:

(a) means for providing a spin frequency signal, a nutation frequency signal and a precession frequency signal;

(b) means for providing a boresight error angle signal;

(c) means, responsive to a control signal, for selectively providing a force in a desired lateral direction comprising:

(i) means for firing a thrust rocket to provide a constant thrust vector in a lateral direction spinning at the spin rate of the projectile;

(ii) means for inertially, stabilizing the constant thrust vector in a desired direction to maneuver the spinning projectile in a corresponding desired direction; and (iii) means for respinning the constant thrust vector such that the thrust vector Spins at the spin rate of the projectile; and (d) means, responsive to the spin frequency signal, the nutation frequency signal, the precession frequency signal and the boresight error angle signal, for providing the control signal to the selectively providing a force means to control the desired lateral direction of the force.

2. The spinning projectile as recited in claim 1 wherein the selectively providing a force means comprises means for providing a maneuver force equal to the sum of a rocket force and a body force.

3. The spinning projectile as recited in claim 1 wherein the means for providing a spin frequency signal, a nutation frequency signal and a precession frequency signal comprises a roll rate sensor.

4. A spinning projectile comprising:

(a) a roll rate sensor to provide a spin frequency signal, a nutation frequency signal and a precession frequency signal;

(b) a seeker to provide a bore sight error angle signal;

(c) a torquer assembly, responsive to a control signal, to provide a force in a desired direction, the torquer assembly comprising:

(i) a constant thrust rocket and a rotating ceramic disk having a nozzle connected to the thrust rocket;

(ii) a motor, coupled to the rotating ceramic disk, to rotate the rotating ceramic disk to control the position of the nozzle relative to the projectile; and (iii) a brake, connected to the rotating ceramic disk, to selectively fix the position of the nozzle relative to the projectile; and (d) a digital signal processor, responsive to the spin frequency signal, the nutation frequency signal, the precession frequency signal and the lead angle signal, to provide the control signal to the torquer assembly.

5. A method of operating a spinning projectile comprising the steps of:

(a) firing a thrust rocket to provide a constant thrust vector in a lateral direction spinning at the spin rate of the projectile;

(b) inertially stabilizing the constant thrust vector in a desired direction to maneuver the spinning projectile in a corresponding desired direction; and (c) respinning the constant thrust vector such that the thrust vector spins at the spin rate of the projectile.

6. The method of operating a spinning projectile as recited in claim 5 wherein the firing a thrust rocket step comprises the steps of:

(a) firing a thrust rocket to provide the constant thrust vector;

(b) inertially stabilizing the thrust vector to trim the projectile to a desired angle of attack; and (c) unstabilizing the thrust vector so that the thrust vector rotates at the spin rate of the projectile.

7. The method of operating a spinning projectile as recited in claim 5 wherein the inertially stabilizing the thrust vector step comprises the step of producing a maneuver force resulting from additive effects of a thrust rocket force and a body lift force.

8. The method of operating a spinning projectile as recited in claim 5 wherein the inertially stabilizing the thrust vector step comprises the step of rotating a nozzle relative to the projectile, the nozzle connected to a thrust rocket, such that the thrust vector is inertially stabilized.

* * * * *